United States Patent [19]

Havelock

[11] Patent Number: 4,662,676

[45] Date of Patent: May 5, 1987

[54] ARM TRAY FOR CHAIR

[76] Inventor: Ken Havelock, 1401 W. 14th St., Sault Ste. Marie, Mich. 49783

[21] Appl. No.: 774,999

[22] Filed: Sep. 11, 1985

[51] Int. Cl.[4] ..... A47C 7/62

[52] U.S. Cl. ..... 297/194; 108/26; 297/160; 297/DIG. 4

[58] Field of Search ..... 211/70.7; 297/194, 160, 297/161, DIG. 4; 108/26, 25; 248/309, 312, 316, 309.2, 500

[56] References Cited

U.S. PATENT DOCUMENTS

| | | | |
|---|---|---|---|
| 950,522 | 3/1910 | Vough | 248/500 X |
| 1,159,673 | 11/1915 | Holybee | 248/500 |
| 2,517,018 | 8/1950 | Nicholson | 114/188 X |
| 2,640,595 | 6/1953 | Byford | 297/194 X |
| 2,808,191 | 10/1957 | Cramer | 108/26 X |
| 3,148,636 | 9/1964 | Bloomquist et al. | 108/26 |
| 3,239,272 | 3/1966 | Wilkins | 297/160 X |
| 3,490,601 | 1/1970 | Hain et al. | 211/70.7 |
| 3,515,429 | 6/1970 | Bollinger | 297/153 |
| 3,690,724 | 9/1972 | Douglas et al. | 297/194 |
| 4,403,786 | 9/1973 | Ulics | 297/DIG. 4 |

*Primary Examiner*—James T. McCall

*Attorney, Agent, or Firm*—John A. Waters

[57] ABSTRACT

An arm tray for a chair comprising a flat tray with a wide front portion and a narrow rear portion that is attached to the arm of a chair by an adjustable hook and pile fabric fastener that wraps around the arm of the chair and an adjustable length removable brace extending between the chair and the tray. The brace is removably attached to a swivel on the underside of the tray and fits on a clip removably attached to the chair leg. The tray includes depressions for a plate and silverware and openings for a napkin and beverage container. Upon projections in the silverware depression fit into openings in the silverware to hold the silverware in place. Removable clips fit on the edge of the tray and extend over the plate depression to hold the plate in place. The beverage container opening has removable sleeves for different sized beverage containers.

12 Claims, 13 Drawing Figures

ARM TRAY FOR CHAIR

BACKGROUND OF THE INVENTION

This invention relates to an arm tray which is designed to be attachable to chairs, particularly wheelchairs. The arm tray contains recesses which accommodate various articles.

At the present time, there are different types of trays which attach to chairs and other structures. However, the means for attaching the trays to the chairs limits the kind of chair that the particular tray can be attached to.

Also, a number of the trays have recesses or holes in them such that various articles can be securely placed thereon. This is particularly true with trays designed for use with a wheelchair. However, none of the prior art discloses a tray that accommodates all of the utensils necessary for eating a meal. Also, none of the presently known trays adequately keep a plate in place on the tray when the chair is moved or when exposed to wind.

SUMMARY OF THE INVENTION

In accordance with the present invention, an arm tray that is easily and releasably attachable to the arm of a chair comprises a generally flat tray having a rear portion adapted to be positioned over the arm of the chair and a wider portion on which articles are placed. The rear portion of the tray is attached to the arm of the chair by a releasable fastener mechanism comprising flexible fastener strips including hook and pile fasteners attached to the underside of the rear portion of the tray. The strips are wrapped around the arm of the chair and overlapped with the hook and pile fasteners being engaged so as to lock the strips together. The hook and pile fastener strips are of a sufficient length to permit the tray to be mounted on chairs having open arms of varying cross-sectional areas. The front portion of the tray is supported in a generally horizontal position by means of a brace mechanism including an elongated support member attached at an upper end to the underside of the tray and extending downwardly to a lower end supported by the chair. A manually releasable brace fastener mechanism releasably attaches the lower end of the support member to the chair.

The support member comprises upper and lower portions that fit together in telescoping fashion with the brace including a locking fastener mechanism for locking the upper and lower portions at a plurality of desired telescoped positions. Desirably the upper end of the support member is pivotably attached to the underside of the tray to permit the brace to be moved to its proper inclined position for attachment to the chair. Brace fastener mechanism for fastening the lower end of the support member to the chair comprises a resilient clip that is releasably attached to the chair. In a chair wherein a cylindrical arm support extends upwardly from a frame to the arm of the chair, the resilient clip comprises a resilient C-clip that clips over the arm support and rests on the frame. The C-clip has an upwardly inclined support arm thereon that fits in an opening in the lower end of the support member and supports the support member.

With a tray constructed in this manner, the tray can easily be adapted to fit on almost any chair, from a lawn chair to a wheel chair.

The arm tray also includes a number of holding devices to retain eating utensils in place on the tray. The holding devices include a plate depression for a plate, an opening through the tray for a beverage container, separate depressions for individual items of silverware, and an opening through the tray for a napkin.

The silverware depressions are generally shaped in the configuration of individual items of silverware but have sufficient room at at least one point to provide finger access between the tray and the silverware to lift the silverware from the depression. The silverware items each have at least one opening therethrough and the depression has mating projections extending upwardly therefrom that fit into and resiliently engage the openings in the silverware to hold the silverware down on the tray. Desirably the plate depression is adjacent the edge of the tray at at least one point and preferably at at least two points on opposite sides of the tray. Resilient plate clips fit over the edges of the tray at these points and include upper portions that fit over the plate depressions and hold a plate downwardly in the plate depression. The resilient plate clips comprise C-clips that fit over the edge of the tray with lower legs extending under the tray and outwardly extending upper portions of the clips extending over the plate depressions. Desirably a downwardly extending portion extends into the plate depression along the edge thereof to hold the clip on the tray. The upper portion extending outwardly over the plate depression is bendably or hingedly movable upwardly from the plate depression in order to permit removal and insertion of plates in the plate depression.

The opening for a beverage container includes a sleeve insert that fits through the opening with an outwardly extending flange on the upper edge of the sleeve insert preventing the sleeve from passing all the way through the opening. The interior diameter of the sleeve engages the outer periphery of the beverage container to hold it in position. Sleeves with varying interior diameters can be used for beverage containers of different sizes.

The tray is formed for maximum ease of use by disabled persons or other persons having limited arm movement. The rear portion of the tray is relatively narrow and includes an upper padded surface that serves as a cushioned elbow rest. The forward portion of the tray tapers outwardly and gradually becomes wider as it extends forwardly. The silverware depressions are formed transversely in the tray adjacent the rear portion of the tray. The plate depression is formed forwardly of the silverware depressions. The beverage container opening is formed forward and to the right of the plate depression. The napkin opening is formed forward and to the left of the plate depression.

The present invention has several advantages. First it is adaptable to a chair of any size and shape and can easily be removed and attached to a chair. The tray also provides secure means for attaching all eating utensils to the upper surface of the tray while still permitting the utensils to easily be removed and reinserted.

These and other advantages and features of the present invention will hereinafter appear and for purposes of illustration but not of limitation a preferred embodiment of the present invention is described in detail below and shown in the appended drawings.

DESCRIPTION OF THE PREFERRED EMBODIMENT

Figure 1:
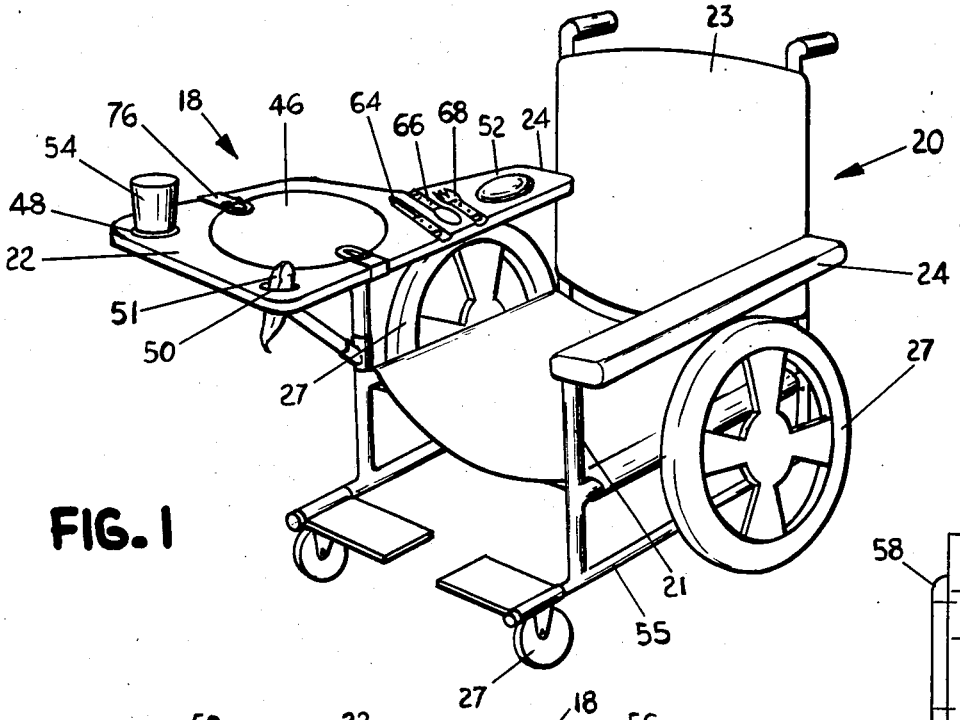
FIG. 1 is a perspective view of the arm tray shown in position for use on a wheelchair.

Referring now to FIG. 1, an arm tray attachment 18 for a chair comprises a generally flat tray 22 releasably attached to a chair 20, in this case a wheelchair. Chair 20 includes a back 23, open arms 24, and chair legs or frame members 21, with the frame members riding on wheels 27.

Figure 2:
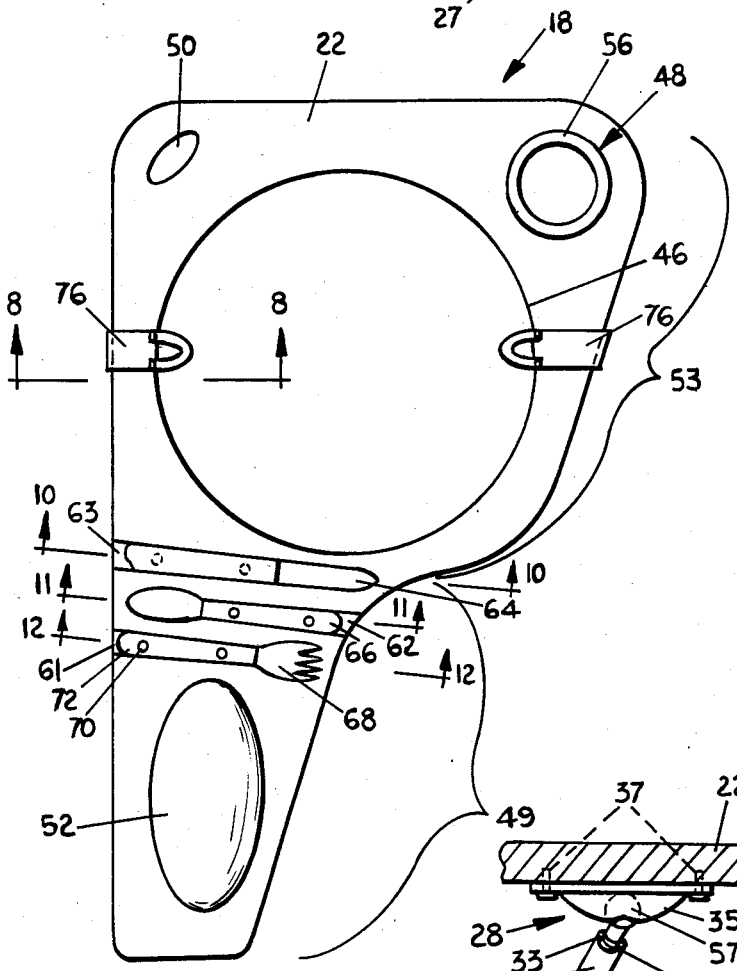
FIG. 2 is a plan view of the arm tray.

As shown in FIG. 2, tray 22 includes a rear portion 49 that is relatively narrow and fits on the arm of the chair and a forward portion 53 that is substantially wider than the rear portion and extends forwardly from the arm of the chair. The forward portion extends outwardly so that the tray does not obstruct access to and from the chair.

Figure 4:
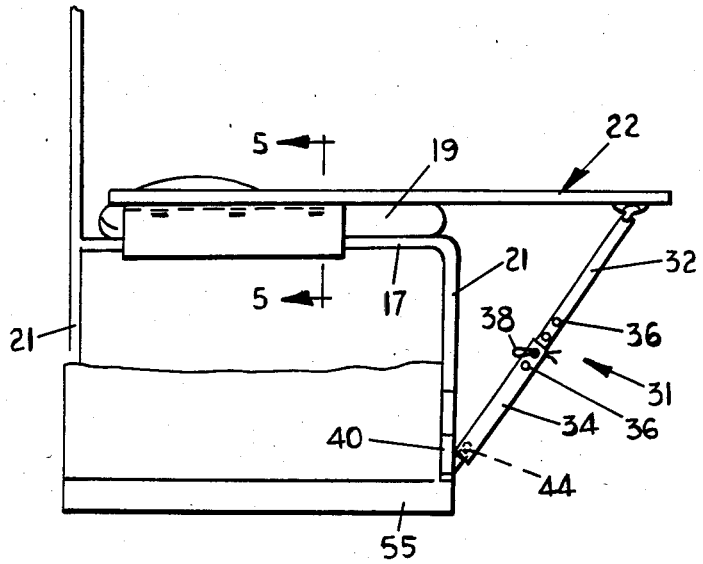
FIG. 4 is a side elevational view showing the arm tray mounted on the arm of a chair.

The manner in which the tray is attached to the chair is shown in FIG. 4. The underside of the rear portion of the tray is positioned on the arm of the chair. The arm of the chair includes a metal arm 17 with a padded arm rest 19 fastened to the top of the metal arm. Frame members 21 extend downwardly from the ends of the arm to a bottom support 55. In the illustrated embodiment, the frame members and metal arm are formed of cylindrical tubular metal.

Figure 5:
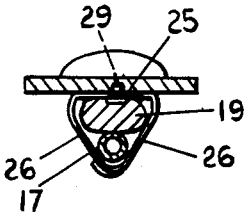
FIG. 5 is a sectional view taken along line 5—5 of FIG. 4.

The rear portion of the tray is held securely down on a chair of any size by means of fastener strips 26, including hook and pile fasteners such as Velcro or the like on opposite strips as shown on FIG. 5. The strips (which may be one continuous strip attached at the middle) are attached to the underside of the tray by means of a strip 25 formed of metal or plastic or the like that fits over the fabric strip and is fastened to the underside of the tray by fasteners 29. The hook and pile fastener strips are desirably fairly wide so they cover a substantial portion of the chair arm. A plurality of thinner strips also could be used.

The strips are sufficiently long so that when they are wrapped around opposite sides of the chair arm they overlap, with the hook and pile fasteners being positioned so that they engage in the overlapped area and lock the tray securely down on the chair arm. The strips are sufficiently long to permit the tray to be mounted on the open arms of chairs of a variety of different cross-sectional areas.

The front end of tray 22 is held in a generally horizontal position by means of an upwardly and outwardly extending brace mechanism 31 that comprises an elongated support member attached at an upper end to the underside of the front end of the tray and attached at a lower end to the chair. The support member comprises an upper portion 32 and a lower portion 34 that fit together in telescoping fashion. Preferably these members are tubular cylindrical members with the upper portion 32 being of slightly smaller diameter than lower portion 34 such that they fit together. The two portions of the support member include aligned openings 36 through the tubes spaced longitudinally along the tubes. These openings 36 are mating at various telescoped lengths of the support member. A cotter pin or similar fastener 38 can be inserted through the mating openings to lock the telescoping support member at any desired length.

Figure 7:
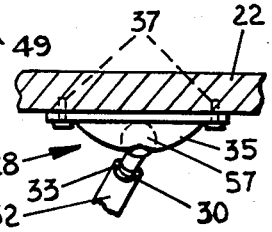
FIG. 7 is a broken side view showing a ball joint connector for retaining the upper end of the brace against the underside of the tray.
Figure 3:
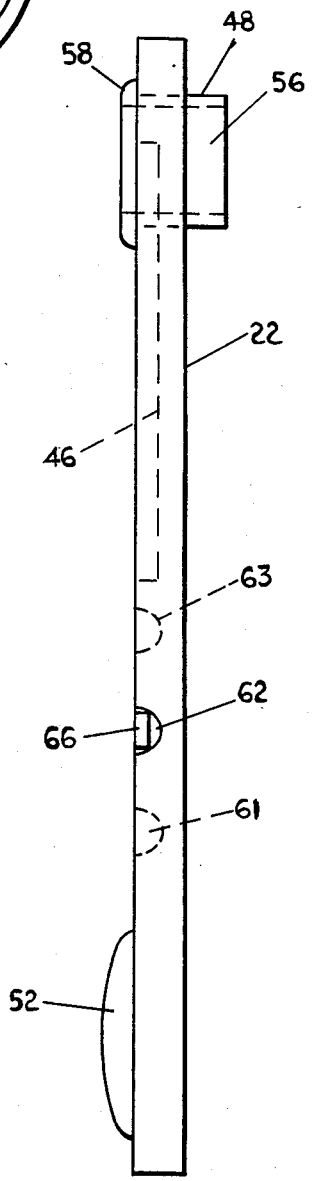
FIG. 3 is a slightly enlarged side view of the arm tray.

As shown in FIG. 7, the upper end of portion 32 is attached to the underside of tray 22 by means of a pivotable mounting mechanism 28. Pivotal mounting mechanism 28 includes a ball joint 57 mounted in a socket 35 that is attached by fasteners 37 to the underside of the tray. Ball joint 57 has a threaded outwardly extending arm 30 that screws into a threaded tubular end 33 of an upper support member 32. The use of a pivoting ball joint at the upper end of the brace permits the brace to be moved to any desired position for attachment to the chair.

Figure 6:
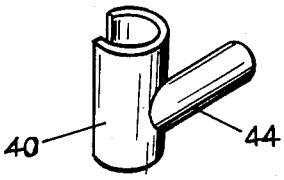
FIG. 6 is a perspective view of a clip for retaining the lower end of the tubular brace against the chair frame.
Figure 8:
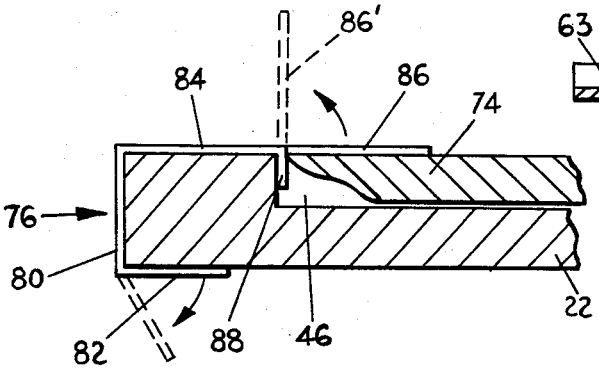
FIG. 8 is a sectional view of the tray taken along line 8—8 of FIG. 2.
Figure 10:
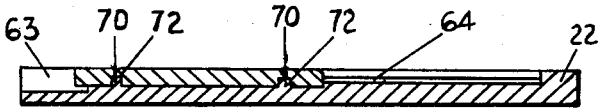
FIG. 10 is a sectional view taken along line 10—10 of FIG. 2
Figure 11:
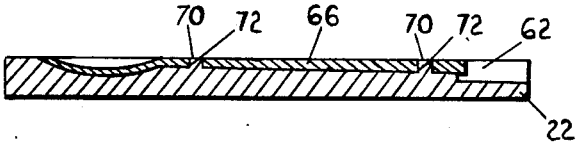
FIG. 11 is a sectional view taken along 11—11 of FIG. 2.

The lower end of the brace is attached to the chair by means of a spring clip 40 shown in FIG. 6. When the leg of the chair is cylindrical, clip 40 takes the form of a C-clip formed of resilient plastic or the like that clips over the edge of the chair. An upwardly and outwardly extending arm 44 fits in the lower end of lower portion 34 and supports the brace on the edge of the chair. The C-clip abuts the frame 55 and is restrained thereby from downward movement. By use of the resilient C-clip in this invention, the brace can easily be removed from the chair simply by resiliently unclipping the clip from the leg of the chair.

The manner in which utensils are held downwardly against the surface of the tray is shown in FIGS. 2, 3 and 8–13. Tray 22 includes holding means for holding various types of eating utensils securely to the surface of the tray. These holding means include a plate depression 46, a beverage container opening 48, a napkin opening 50 for a napkin 51 (FIG. 1), silverware recesses 61, 62 and 63 for a fork, spoon, and knife respectively, and a padded elbow rest 52 on the upper surface of the rear portion of the tray.

As shown in FIG. 1, a beverage container 54 with tapered sides is placed in the beverage container opening until the sides of the beverage container snugly engage the sides of the beverage container opening. A flange (not shown) could be provided at the underside of the opening to retain straight sided beverage containers. To improve the holding action of the container opening, a tubular beverage adapter 56 can be inserted into the beverage container opening 48 to adjust the diameter of the opening and lengthen the sides of the opening. Adapter 56 comprises a tubular sleeve having an outwardly extending flange 58 that is larger than the diameter of the beverage container opening 48 so as to prevent the sleeve from sliding all the way downwardly through the opening. The inner diameter of the sleeve engages the outer periphery of the container to hold the container in the opening. Sleeves with a variety of inner diameters can be used for accommodating beverage containers of varying outside diameters.

Eating utensil recesses 61, 62, and 63 desirably are formed adjacent the rear portion of the tray transversely across the tray. Each recess is shaped to accommodate a specific eating utensil such as a knife 64, spoon 66, and a fork 68. Each recess is longer than the eating utensil itself so that the utensil can easily be removed from the recess by inserting the finger between the utensil and the recess. The recesses contain upwardly extending projections 70 that fit through mating apertures 72 in the eating utensils to resiliently and securely hold the eating utensils in place on the arm of the tray when not in use. Projections 70 extend all the way through the fork and the spoon but extend only a portion of the way through the knife (See FIG. 10).

Figure 9:
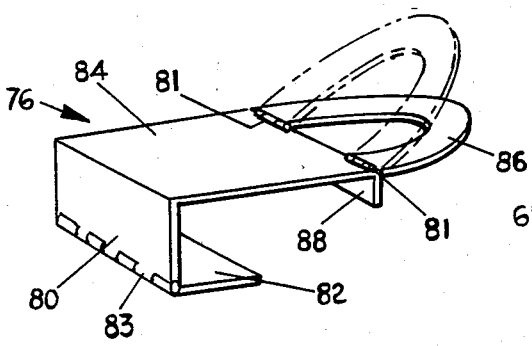
FIG. 9 is a perspective view of the plate holder of the present invention.
Figure 12:
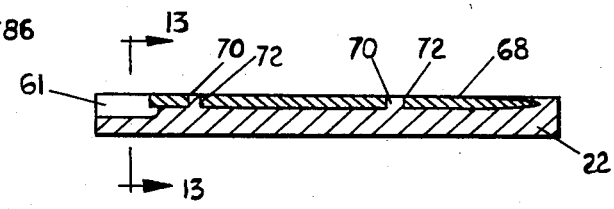
FIG. 12 is a sectional view taken along line 12—12 of FIG. 2.
Figure 13:
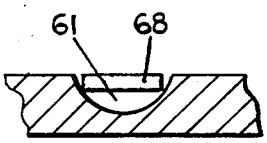
FIG. 13 is a sectional view taken along line 13—13 of FIG. 12.

As shown in FIG. 2, the plate depression 46 is adjacent the outer and inner edges of the tray on opposite sides of the tray. Plate holders or clips 76 and 76' clip over the side edges of the tray at these points and extend inwardly over the edges of the plate depression to hold the plate 74 (FIG. 8) down in the plate depression. Plate holders 76 and 76' comprise resilient C-clips that clip over the edge of the tray. The C-clip includes an outer side 80 that abuts the edge of the tray, a lower leg 82 that fits under the edge of the tray (which can be hinged to outer side 80 by resilient hinge 83 such that lower leg 82 is bendable downwardly in the manner shown in FIG. 8 to remove the clip from the tray), an elongated upper portion 84 that abuts the top surface of the tray, and an outer end 86 that protrudes outwardly over the plate depression and over the edge of plate 74. Hinges 81 connect outer end 86 to the inner portion 84 and can be bent upwardly to the vertical position shown by phantom FIG. 86' in FIG. 8 to permit removal of the plate. Hinges 81 and 83 could be replaced by a living hinge of the type used in plastic products. Plate holder 76 also includes a downwardly extending portion 88 that extends downwardly into the plate depression at the edge thereof. Downwardly extending portion 88 holds the clip on the edge of the tray and prevents the clip from slipping off the edge of the tray. As shown in FIG. 9 outwardly extending portion 86 can be in the form of a curved loop.

It should be understood that the foregoing embodiments are merely illustrative of the preferred practice of the present invention and that various modifications and changes may be made in the arrangements and details of construction of the embodiments shown herein without departing from the spirit and scope of the present invention.

What is claimed is:

1. An arm tray that is easily and releasably attachable to the open arm of a chair comprising:

a generally flat tray having a rear portion adapted to be positioned over the arm of the chair and a front portion on which articles are placed;

releasable fastener means for attaching the tray to the arm of the chair; and holding means for retaining eating utensils on the tray, the holding means comprising a plate depression for a plate, an opening in the tray for a beverage container, and separate depressions for individual items of silverware, the depressions for the silverware including releasable retainers for resiliently holding the silverware down on the tray.

2. An arm tray that is easily and releasably attachable to the open arm of a chair comprising:

a generally flat tray having a rear portion adapted to be positioned over the arm of the chair and a wider front portion on which articles are placed;

a releasable fastener means for attaching the rear portion of the tray to the arm of the chair, the fastener means comprising flexible fastener strips including hook and pile fasteners attached to the underside of the rear portion of the tray, such that the strips can be wrapped around the arm of the chair and overlapped with the hook and pile fasteners being engaged so as to lock the strips together, the fastener strips fastening the rear portion of the tray securely down on the arm of the chair, the rear portion of the tray being removable simply be separating the hook and pile fasteners, the fastener strips being long enough to permit the rear portion of the tray to be mounted on chair arms with a wide variety of different cross sectional areas, and the length of the support member being adjustable to hold the tray level on different sizes and shapes of chairs;

a removable brace means for suporting the front portion of the tray, the brace means comprising an elongated support member attached at an upper end to the underside of the tray and extending downwardly to a lower end adapted to be supported by the chair, the support member comprising upper and lower portions that fit together in telescoping fashion, the brace including locking fastener means for locking the upper and lower portions at a plurality of desired telescoped positions, the upper end of the support member being pivotally attached to the underside of the tray; and releasable brace fastener means for releasably supporting the lower end of the support member on the chair, the tray being removable from the chair by releasing the hook and pile fastener strips and releasing the support member from the chair, the brace fastener means for supporting the lower end of the support member comprising a resilient clip releasably attachable to the chair.

3. An arm chair according to claim 2 wherein the arm of the chair is supported by a cylindrical arm support that extends upwardly from a frame to the arm of the chair, the resilient clip comprising a resilient C-clip that clips over the arm support and rests on the frame, the C-clip having an upwardly inclined support arm thereon that fits in an opening in the lower end of the support member and supports the support member.

4. An arm chair tray according to claim 2 wherein the upper and lower portions are mating tubular members, with each having a plurality of aligned holes spaced longitudinally along the tubular member, the holes in the tubular members mating at selected extension lengths of the brace, the fastener means comprising a pin that fits through the mating openings.

5. An arm tray that is easily and releasably attachable to the open arm of a chair comprising:

a generally flat tray having a rear portion adapted to be positioned over the arm of the chair and a wider front portion on which articles are placed;

a releasable fastener means for attaching the rear portion of the tray to the arm of the chair;

holding means for retaining eating utensils on the tray, the holding means comprising a plate depression for a plate, an opening in the tray for a beverage container, and separate depressiions for individual items of silverware, the depressiions for the silverware including releasable retainers for resiliently holding the silverware down on the tray;

a removable brace means for supporting the front portion of the tray, the brace means comprising an elongated support member attached at an upper end to the underside of the tray and extending downwardly to a lower end adapted to be supported by the chair; and releasable brace fastener means for releasably supporting the lower end of the support member on the chair, the tray being removable from the chair by releasing the fastener means for the tray from the arm and releasing the support member from the chair.

6. An arm tray according to claim 6 wherein the rear portion of the tray is relatively narrow and includes a padded upper surface for elbow support, the front portion becoming wider as the tray extends forwardly from the rear portion to the front edge of the tray, the silverware depression being formed transversely in the tray adjacent the rear portion of the tray, the plate depression being formed forward of the silverware depressions, and the beverage opening being formed forward of and to the right of the plate depression, the arm tray further comprising a napkin opening through the tray for holding a napkin.

7. An arm tray that is easily and releasably attachable to the open arm of a chair comprising:

a generally flat tray having a rear portion adapted to be positioned over the arm of the chair and a wider front portion on which articles are placed, the tray further comprising silverware depressions in the upper surface of the tray generally shaped in the configuration of the individual items of silverware, each silverware depression having sufficient room at least at one point to provide finger access between the tray and the silverware items each having at least one opening therein, the depressions having mating projections extending upwardly therefrom that fit into and resiliently engage the openings in the silverware to hold the silverware down on the tray;

a releasable fastener means for attaching the rear portion of the tray to the arm of the chair, the fastener means comprising flexible fastener strips including hook and pile fasteners attached to the underside of the rear portion of the tray, such that the strips can be wrapped around the arm of the chair and overlapped with the hook and pile fasteners being engaged so as to lock the strips together, the fastener strips fastening the rear portion of the tray securely down on the arm of the chair, the rear portion of the tray being removable simply by separating the hook and pile fasteners;

a removable brace means for supporting the front portion of the tray, the brace means comprising an elongated support member attached at an upper end to the underside of the tray and extending downwardly to a lower end adapted to be supported by the chair; and releasable brace fasteners for releasably supporting the lower end of the support member on the chair, the tray being removable from the chair by releasing the hook and pile fastener strips and releasing the support member from the chair.

8. An arm tray according to claim 1 wherein the beverage container opening comprises an opening in the tray and a removable sleeve that fits in the opening, the sleeve having an outwardly extending flange adjacent an upper end thereof that prevents the sleeve from falling through the opening, the inner diameter of the sleeve conforming to the outer diameter of the beverage container so as to hold the beverage container in the opening, the sleeve being replaceable with a sleeve having a different inside diameter to conform with a different sized beverage container.

9. An arm tray that is easily and releasably attachable to the open arm of a chair comprising:

a generally flat tray having a rear portion adapted to be positioned over the arm of the chair and a front portion on which articles are placed;

releasable fastener means for attaching the tray to the arm of the chair; and holding means for retaining eating utensils on the tray, the holding means comprising separate depressions for individual items of silverware, the depressions including releasable retainers for resiliently holding the silverware down on the tray, the silverware depressions being generally shaped in the configurations of the individual items of silverward, each silverware depression having sufficient room at least one point to provide finger access between the tray and the silverware to lift the silverware from the depression, the silverware items having at least one opening therein, the depressions having mating projections extending upwardly therefrom that fit into and resiliently engage the openings in the silverware to hold the silverware down on the tray.

10. An arm tray according to claim 9 wherein the holding means for retaining eating utensils further comprises a plate depression for a plate, and an opening in the tray for a beverage container.

11. An arm tray that is easily and releasably attachable to the open arm of a chair comprising:

a generally flat tray having a rear portion adapted to be positioned over the arm of the chair and a wider front portion on which articles are placed;

releasable fastener means for attaching the tray to the arm of the chair; and holding means for retaining eating utensils on the tray, the holding means comprising a plate depression in the upper surface of the tray positioned adjacent the outer edge of the tray at least at one point, the arm tray further including a resilient plate clip that fits over and resiliently engages the edge of the tray at said one point, the plate clip including an upper portion that protrudes over the edge of the plate depression so as to hold down a plate in the plate depression, the plate clip including a C-clip portion that fits over and resiliently engages the edge of the tray and an outwardly extending upper portion that protrudes over the edge of the plate depression, the upper portion being upwardly movable to permit removal of the plate from the tray, the outwardly extending upper portion of the plate clip including a downwardly extending flange that fits downwardly into plate depression at the edge thereof to hold the clip in position on the tray, the part of the upper portion extending outwardly over the plate depression from the downwardly extending portion being movable upwardly to permit removal of a plate from the tray.

12. An arm tray according to claim 11 wherein the plate depression is adjacent the edge of the tray in at least two locations on opposite sides of the tray, the arm tray incluiding at least two plate clips for holding a plate in the plate depression.

* * * * *